US007409777B2

(12) United States Patent
Shiveley

(10) Patent No.: US 7,409,777 B2
(45) Date of Patent: Aug. 12, 2008

(54) RAPID EFFICIENT INFRARED CURING POWDER/WET COATINGS AND ULTRAVIOLET COATINGS CURING LABORATORY APPLIED PRODUCTION PROCESSING

(76) Inventor: James Thomas Shiveley, 10965 Tanager Trail, Brecksville, OH (US) 44141

( * ) Notice: Subject to any disclaimer, the term of this patent is extended or adjusted under 35 U.S.C. 154(b) by 199 days.

(21) Appl. No.: 09/851,720

(22) Filed: May 9, 2001

(65) Prior Publication Data

US 2002/0034594 A1 Mar. 21, 2002

Related U.S. Application Data

(60) Provisional application No. 60/202,788, filed on May 9, 2000.

(51) Int. Cl.
*F26B 3/34* (2006.01)

(52) U.S. Cl. ..... 34/275

(58) Field of Classification Search ..... 34/266, 34/275; 118/663

See application file for complete search history.

(56) References Cited

U.S. PATENT DOCUMENTS

| | | | | | |
|---|---|---|---|---|---|
| 2,876,187 | A | * | 3/1959 | Wolinski | 522/165 |
| 3,851,402 | A | * | 12/1974 | Tumball et al. | 34/548 |
| 4,916,487 | A | * | 4/1990 | Yamada | 399/81 |
| 5,117,562 | A | * | 6/1992 | Dulay et al. | 34/550 |
| 5,124,552 | A | * | 6/1992 | Anderson | 250/339.04 |
| 5,901,462 | A | * | 5/1999 | Rudd | 34/274 |

OTHER PUBLICATIONS

Applicant's brochure TB-294 (Back Lower Right) Items 1 through 3 of the enclosed brochure are related equipment of the applicant, while items 4 and 5 are subject of the present application.

* cited by examiner

*Primary Examiner*—S. Gravini
(74) *Attorney, Agent, or Firm*—Brouse McDowell

(57) ABSTRACT

Apparatus and method for curing coating on articles using multi wavelength IR and UV energy sources, which can be pulsed in a system for analyzing and producing in-line programmed production of the finished product.

20 Claims, 2 Drawing Sheets

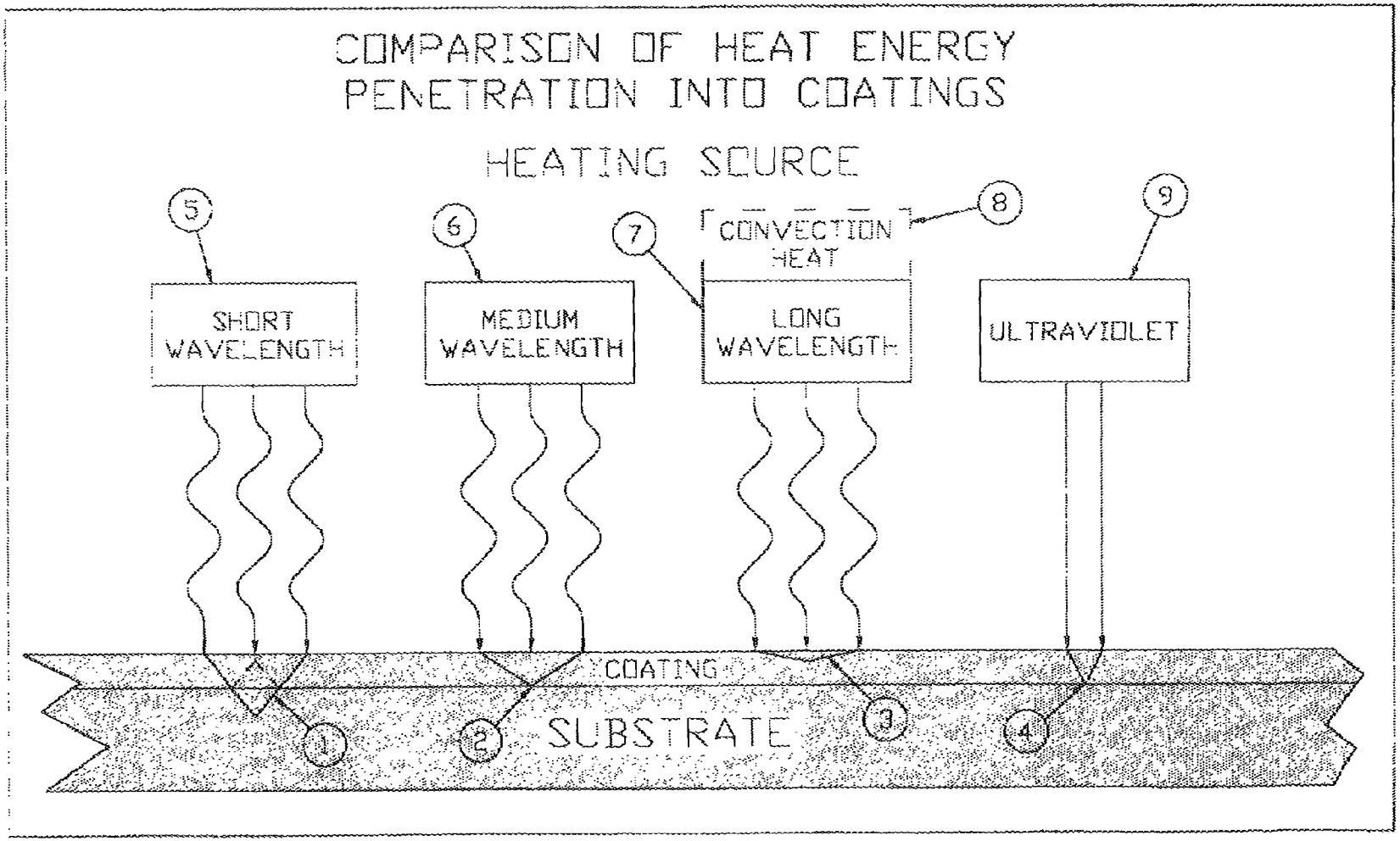
Fig #1

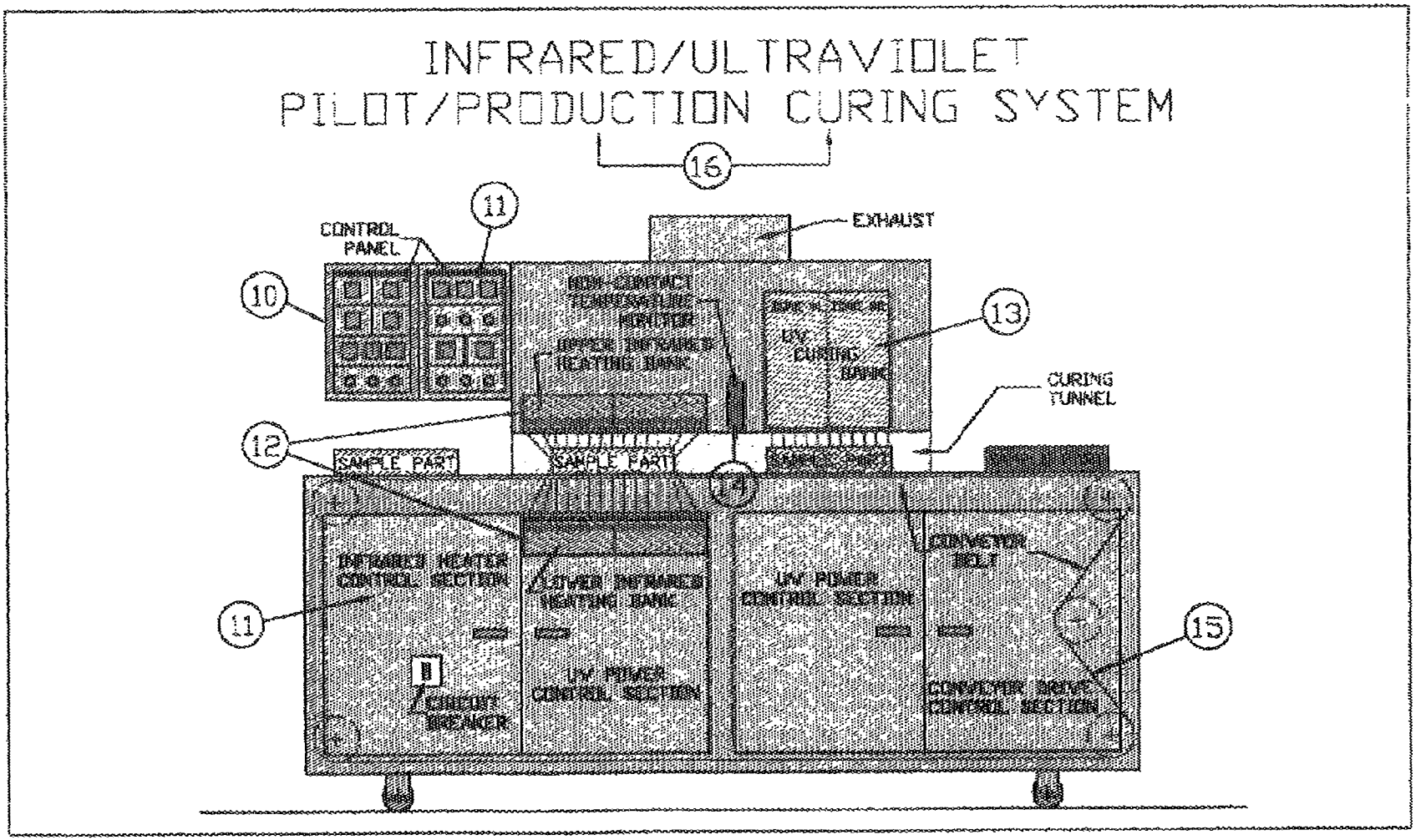
Fig. #2

RAPID EFFICIENT INFRARED CURING POWDER/WET COATINGS AND ULTRAVIOLET COATINGS CURING LABORATORY APPLIED PRODUCTION PROCESSING

This utility application claims priority to U.S. Provisional Patent Application Ser. No. 60/202,788 filed on May 9, 2000.

BACKGROUND OF THE INVENTION

1. Field of Invention

Known methods of thermally curing coatings in laboratories and production facilities, include:

a.) heating of coatings via hot air convection ovens, which may require 25-45 minutes for full curing;

b.) infrared pre-heating coatings prior to convection heating, which reduces the curing time; and, c.) infrared heating coatings for the total curing process which offers significant reduction of curing time, see Applicant's co-pending application Ser. No. 09/843,967, filed in Apr. 27, 2001 disclosing an in-line curing operation.

The above-methods include the coating curing process of:

a.) powder coat processing where the powder is heated until it gels and held at a curing temperature for, in most materials, cross polymerization; and, b.) wet coat processing where fluid is driven from the coating and held at a curing temperature for thermal setting or cross polymerization.

There are numerous types of coating materials, all of which require specific curing temperature vs. time profiles when processing wet coatings. Also, specific gels and processing temperature vs. time profiles are required when processing powder-coating products. Normally, specific process details for establishing production finishing systems having appropriately designed features are not available to the finishing system designers. This can potentially cause over or under design of the required production facility.

Known methods of curing coatings via ultraviolet energy sources include preheating the powder coating to a gel temperature prior to being exposed to the ultraviolet energy source. This process typically utilizes an infrared energy source operating in the medium wave length range, which permits energy to be transferred into the coating via radiant energy penetration principles. This method offers significantly improved energy transfer rates. Using medium wavelength energy, normally does not allow penetration deep enough to directly introduce heat into a substrate material on which this coating is placed. The substrate material will in turn draw energy from the coating. The thicker the substrate, the greater the energy drawing magnitude; thus, creating large temperature gradients across the coating thickness and extending the processing time. Energy is drawn from the coating, which delays a wetting action between the coating and substrate. This energy drawing of the substrate from the coating also increases the temperature gradients across the coating thickness which decreases uniform cross linking and/or curing of the coating material. The greater the temperature gradients across the coating, the greater the time lag of the bonding process between the coating and the substrate. The higher the temperature of the substrate, the better the wetting action and thus, the better the bonding action at a coating and substrate interface.

The process may utilize conventional hot air convection or long wavelength infrared heating sources to apply energy to the surface molecules of the coating (no radiation penetration) in this case, the energy is transferred inward by conduction principles. These methods require substantial time and create significant undesired temperature gradients across the coating thickness. These sources of energy require significantly longer times to process than the afore-mentioned medium wavelength infrared source.

It is also known to use short wavelength energy sources as a means of curing coatings. When short wavelength energy sources are utilized, they offer the ability to heat the coating very rapidly, and, in most coatings materials, penetrate through the coating. Most of the energy is deposited in the coating; however, a substantial amount of energy is still delivered into the substrate. The amount of energy introduced into the substrate is affected by the coating material's formulation and thickness. This introduction of energy into the substrate reduces the temperature gradient across the coating thickness, and enhances initiation of the on-set of polymerization or curing, as well as, bonding at the coating and substrate interface.

Even though the short wavelength energy source has excellent capabilities, there are inherent features in certain applications, which create limiting processing conditions. For example, when the energy needs to be reduced in an appropriately designed curing system because the conveying mechanism velocity must be reduced, the normal response is to reduce the voltage in order to reduce energy. The wavelength of the energy source may be reduced to provide a temperature where its wavelength may be in the medium or long wavelength energy spectrum, which diminishes the unique features of short wavelength energy. Examples of these limitations would be one where a curing oven, utilizing short wavelength sources, was appropriately designed for a given production velocity and a need to reduce the velocity develops due to a production limitation. In this case, the energy wavelength would be greatly changed, causing process deficiencies due to inadequate energy penetration.

Normally, when curing coatings with ultraviolet energy sources, the coatings are thermally processed before exposure to the ultraviolet source. The pre-heating methods and their inadequacies are noted above. Ultraviolet energy sources have discrete energy radiation peaks. Critical production and specification requirements can arise from the paint manufacturer. Their enhancing light sensitive additives must function at discrete frequencies of the process ultraviolet energy source to attain adequate curing.

There are numerous types of coating materials, all of which require specific pre-heat temperature/time profiles and ultraviolet energy spectrum data. The lack of laboratory test information and its coordination with production performances sometimes leads to the construction of production facilities being under or over designed.

Laboratory pilot test systems typically consist of a conveyorized arrangement, which requires significant floor space. They normally utilize a single type of thermal source with minimal process controls. These systems include heating methods with inadequacies as defined above. They likewise include minimal programming and recording instrumentation.

SUMMARY OF INVENTION

In one aspect, the invention is one that offers to the coating industry two discrete systems consisting of concepts and hardware relating to coating suppliers and coat finishing processors.

The invention relates to thermally processing wet and dry coatings via an extended number of pre-programmed control instructions. The energy sources may consist of hot convection air, short, medium, or long wavelength infrared or ultraviolet energy sources in laboratory and production applications. The pre-heat capabilities may be applied prior to introducing ultraviolet energy on to the coating. The system provides one or more ultraviolet sources normally with multiple radiation peak frequencies offering greater process versatility.

The invention includes a pilot/production, analyzing/curing system having at least one infrared heating energy source, at least one UV heating energy source, conveying means for moving articles to be treated past the energy sources, programmable recording/controller first analyzing the treatment of coating on the coated articles and subsequently controlling treatment of the coated articles in accordance with the previous analysis, and a temperature monitor for detection of the article temperature.

Also, included is a method of curing coating on articles including the steps of heating and analyzing a sample of the article, optimizing the heating time, temperature and energy for the best cure of the article and submitting the article to the optimized parameters to cure the coating on the article.

A further method of this invention is curing coating on articles including the steps of heating the article with an infrared energy source and curing the coating on the article using an ultra violet energy source.

Still another method of the invention is curing coatings on articles using a high intensity short wavelength energy source including the steps of pulsing the energy source to penetrate the coating and heat the substrate for the coating, in addition to heating the coating from one side, resulting in the substrate in turn heating the coating from the other side and preventing the coating from heating the substrate by maintaining the substrate above the coating temperature whereby uniform heating and curing of the coating is accomplished.

The system of the invention establishes, a means for a coating manufacturer to perform laboratory tests to develop real dynamic optimum process values while recording the programmed processes and their resultant performances. This data may be presented to their users (production finishing processors) for appropriate processing methods and standards. Other advantages of the invention are:

a.) the ability of the coating manufacturers to appropriately determine the process characteristics of his products as exposed to extended variations of processing sources and methods to determine the optimum process for delivering the maximum product qualities;

b.) the ability of the coating equipment designers to utilize the pertinent developed process data from the coating manufacturing to design production equipment with optimum features to appropriately process the coatings in a production operation;

c.) the availability of established coating product's various processes and quality parameters for determining the optimum process while considering major concerns; such as, quality of the finished product vs. cost. These costs relate to energy, equipment installation, associated labor and plant real estate (floor space). These established optimum process parameters may be utilized to design (lay-out) production equipment offering energy efficient, high production finishing systems producing high quality finished products requiring minimal real estate.

DESCRIPTION OF DRAWINGS

FIG. 1 is a schematic illustrating various energy samples useful with the present invention.

FIG. 2 is a schematic of apparatus in accordance with the present invention.

DETAILED DESCRIPTION OF THE INVENTION

In one aspect the invention is a versatile laboratory/pilot test system (16) for extensive thermal and ultraviolet processing arrangements with advanced process programming/controlling/recording provisions. The laboratory pilot/testing system includes a single station, thermal processing source (12) capable of delivering short, medium and long wavelength energy established by programmed instructions. The energy source may be programmed for power level set, or coating surface temperature "closed loop" control. The system incorporates complex timing circuits for short wavelength infrared-pulsed energy control of process heating applications such as pre-heating and/or curing/drying. Included is a, programmable controlled conveying means (15) for transferring an article (substrate) through the thermal heating and ultraviolet zones. The transfer system's velocity is variable and it may be reversed for improved time exposure options.

In another aspect the invention is a versatile production coating curing system for thermally processing and/or ultraviolet exposing of a coated work-piece. A wide array of coatings may be applied to various work-piece materials; such as metal, wood, paper, plastic, glass, and ceramics.

The system includes a heating source or sources capable of delivering appropriate energy levels at an exposure time as programmed. The heating zone (heating source) is capable of operating as:

a.) Pre-heat zone while utilizing short wavelength energy (5), (see FIG. 1), which offers extremely high heating rates; thus, reducing processing time. Short wavelength energy penetrates deeply into most coating materials and normally certain amounts of the energy extends through the coating into the substrate. The heating of a substrate, that portion adjacent the coating, enhances the wetting action between the coating and the substrate. These characteristics offer very high heating rates, and low thermal temperature gradients across the coating thickness for minimal processing time.

b.) Alternatively, the heating zone is a curing oven zone operating as a medium wavelength energy (6 of FIG. 1) source for the purpose of holding the coating temperature at the appropriate curing temperature. Medium wavelength energy is normally absorbed in the coating and does not extend to the substrate.

c.) In still another alternative, the heating zone is a curing oven zone operating as a long wavelength energy source (7) and may be used to hold the coating surface at the appropriate curing temperature. Long wavelength energy is absorbed at the surface of the coating only (there is no penetration in the coating).

Lastly, a convection-heating source could be substituted for the long wavelength source to provide a curing zone while utilizing hot convection air (8 of FIG. 1) to maintain the surface temperature at the desired curing temperature.

The system includes an ultraviolet radiation source (9) (one or more) for radiation curing activation. Also, included is a control system (see FIG. 2) containing necessary control equipment for varying heating source energy at a programmed power level or coating surface temperature (14) for an appropriate processing time. All necessary control circuits (11), for delivering pulsing signals to the energy source to maintain the desired power or temperature level.

The above system flexibility results in unique wet/dry coating curing/drying process advantages include:

a.) plurality of process variables and methods for establishing optimum process parameters and methods for producing high quality cured coatings, wherein the system includes the controls (10) incorporated therein to accomplish these control parameters and the recording instrumentation; and b.) control circuitry and heating sources for short (12) wavelength pulsed heating and control as utilized in laboratory and production coating curing as applied to wet/dry coatings.

The heating zone further includes a pulsed short wavelength infrared energy method of heating:

a.) providing accelerated heating and processing rates of the coated work-piece or article by greatly reducing process time and the real estate required for processing;

b.) pulsed energy also provides considerable energy savings due to the fact that the surface of the substrate is heated so quickly that the wetting action between the substrate interface and coating as well as the cross linking or curing the coating occurs so rapidly that minimal energy is drawn via heat sinking into the work-piece. Faster cool down time, of the work-piece, after curing also results since minimal energy has been introduced into the depth of the work-piece.

c.) further, pulsed energy gives improved coating to work-piece adhesion resulting from the excellent wetting action between the coating and the work-piece, and uniformity of cross linking and/or curing across thickness of the coating, since the heating of the interface (work-piece); the temperature across the coating thickness is greatly reduced which permits the cross linking action to take place evenly across the coating thickness;

d.) even further, pulsed energy permits wide utilization of the process as it may be applied to a wide range of coat curing and plastic product thermal processing; and e.) lastly, our invention utilizes pulsed short wavelength infrared energy for curing wet/dry coatings, where the pulsed energy is utilized to penetrate through the coating into the substrate vs. conventional heating means which introduces energy only in to the coating (no energy directly introduced into the substrate). This occurs conventionally only after the coating has been raised to its curing temperature via conventional short wavelength infrared heating or other heating means. In order to maintain the coating at its curing temperature, it is a common practice to utilize conventional heating methods, of heating the coated work-piece, via hot air convection, medium or long wavelength infrared heating. The conventional heating methods are considerably slower (process time wise).

For example, medium wavelength infrared energy source releases its energy into the coating; however it does not penetrate deep enough in the coating to introduce energy into the substrate (work-piece). Long wavelength infrared energy sources introduce energy to the surface molecules (only). The energy then is slowly conducted inward hot air convection energy is introduced to the surface molecules (only). The energy then is slowly conducted inward.

On the other hand, short wavelength infrared energy introduces its energy deep into the coating thickness and normally extends through the coating with some energy introduced into the work-piece. This approach permits the ability of introducing reasonably large energy level into the coating curing process offering rapid curing without damage to the coating. Refer to FIG. #1 for comparisons of various energy sources and their energy penetration responses.

Thermal processing of plastic work-pieces may utilize this invention process as the pulsed energy penetration principle applies to plastic related materials.

The present invention pilot/production system offers the advantages of both infrared and ultra violet energy sources.

It also has extreme versatility of testing methods:

For example, it can pre-heat powder coat to gel temperature prior to ultra violet energy exposure via direct in-line part transfer using a variable infrared power level setting, which may be of short, medium and long wavelength sources using a variable exposure time, or a variable UV (ultra violet) power level setting, which may have dual UV sources, dual zones (independently controllable) using a variable exposure time set. Further, variable conveyor velocity can be set using a belt drive programmed to reverse direction for extended exposure time in conjunction with a selectable number of cycles.

The system can also pre-heat/cure powder coat and wet coat prior to ultraviolet energy exposure via direct in-line part transfer, using all the variables selectable in the first examples above.

In a third example, the system can pre-heat/cure powder coat and wet coat by advancing the drive to move the part under the infrared heater and hold for complete gel and/or curing of powder coat or complete curing of wet coat prior to the part being passed under the UV energy source. In this example the surface temperature of the coating's surface may be monitored via a non-contact temperature detector (14) (see FIG. 2). Further, coating surface temperature may be selected as an input command signal for closed loop temperature control, and short, medium and long wavelength energy is available via the infrared heater and may be programmed accordingly. In this example, the wavelength and energy (watt sq. in.) are directly related to the rate of processing and the quality of the product, and utilizes our standard 100 watt sq. in. infrared heater module.

As an option, hot forced air can be provided simulate heating by convection ovens. In still another example, the system is designed to monitor and/or control the temperature of the work-piece, while under the infrared heater for a predetermined time and energy wavelength. Utilization of an additional (optional) temperature monitor (not be illustrated and to be located at the product's exit, point from the UV energy source) can enhance the flexibility of process control.

The following parameters are indicatable:

A. Temperatures of:

a.) coating surface b.) substrate

B. IR heater source voltage

C. UV emitter source voltage

D. Electrical signals of these parameters are available for customer's recording.

The expected heating rate performance of the infrared heating zone while heating one side of an 18 gage steel plate is to heat from room temperature to 350° F. in one minute or less via short wave energy. This rate could be reduced to approximately one half minute if heaters were located under the part (substrate) (option). In the present system, short wavelength energy generally can heat at approximately two to three times the rate of a medium wavelength heater (this is presuming 100 watt sq. in. short wavelength source). This short wavelength energy penetrates deeper into the coating where it may introduce some energy into the substrate, which in turn, may offer improved wetting of the coating to the substrate. A short wavelength heater can perform as a medium wavelength emitter by reducing the voltage controlling its performance, but a conventional medium wavelength heater cannot perform as a short wavelength emitter. Similarly, a short wavelength heater can perform as long wavelength emitter upon further reduction of the voltage controlling its performance, but a conventional long wavelength heater cannot perform as a short wavelength, or a medium wavelength emitter.

The expected performance of the ultraviolet processing zone, for very thin coatings, such as a graphic application, is substantial requiring little or no preheating. Where significantly thick coatings are processed, preheating greatly enhances the process, when used before UV processing. For example, in cases of powder coat, at a minimum, gelling is required. The ultraviolet energy source features include a.) Variable power level b.) Wide frequency spectrum with solid frequency distribution over the full range of the spectrum.

Cold mirror IR cut filters are available for minimizing radiated IR energy to the product, when UV is utilized for specific temperature sensitive plastics and specialized graphic applications.

The ultraviolet energy source hardware can include:

Zone A

A. Twenty inch, 600 watt sq. in., energy source with a reasonably consistent energy spectrum distribution.

a.) It is believed this source offers the customer a wider selection of coatings with less specific additive formulation requirements, resulting in less production costs and simplifies production controls.

b.) This energy source can propagate to nearly a twelve-inch range.

Zone B

A. Twenty inch, 600 watt sq. in., energy source with a somewhat sparse energy spectrum distribution.

a.) This energy source has been utilized effectively by the selection of specific lamp sources for dedicated applications.

b.) This energy source can propagate to nearly a four-inch range.

The two types of UV energy sources would be arranged linearly (processwise), and each source may or may not be utilized for a given test. This arrangement permits the comparison of the two types of sources in treating a given workpiece. One of the sources may have its lamp changed to a different type for greater flexibility. These various types of lamps (optional item) can be included with the bas system permitting a variety of UV source spectrum distributions. Lastly, the belt drive may be reversed for multi-passes under the UV source of sources.

Although the present invention has been described in considerable detail with reference to certain preferred versions thereof, other versions are possible. Therefore, the sphere and scope of the appended claims should not be limited to the description of the preferred versions contained herein.

I claim:

1. A powder coating system, comprising:

a conveyor component adapted to support powder coated articles, and to move the articles;

at least one infrared radiation source adapted to emit short, medium, or long wavelength infrared radiation or any combination thereof, the at least one infrared radiation source defining at least one thermal heating zone where the at least one infrared source is in radiant thermal communication with the conveyor component;

a programmable infrared controller circuit in electronic controlling communication with the at least one infrared radiation source, the infrared controller being adapted to tune the infrared source to a selected peak infrared wavelength; and a programmable conveyor controller circuit in electronic controlling communication with the conveyor component, the conveyor controlling circuit being adapted to control the speed and direction of the conveyor component.

2. The system of claim 1, further comprising at least one UV radiation source defining at least one ultraviolet zone where the at least one UV source is in radiant communication with the conveyor component, and wherein the at least one ultraviolet zone is spatially separated from the at least one thermal heating zone, and further comprising a programmable UV controller circuit in electronic controlling communication with the at least one UV radiation source.

3. The system of claim 1, further comprising a temperature detector for measuring the temperature of a coated article, the temperature detector being adapted to sense the temperature of a work piece, and feed the temperature data back to at least one controller circuit.

4. The system of claim 3, wherein the at least one controller circuit includes the programmable infrared controller circuit, and wherein the infrared controller circuit is adapted to adjust the infrared output of the at least one infrared source in response to temperature data received from the temperature detector.

5. The system of claim 3, wherein the at least one controller circuit includes the programmable UV controller circuit, and wherein the UV controller circuit is adapted to adjust the UV output of the at least one UV source in response to temperature data received from the temperature detector.

6. The system of claim 1, wherein the at least one infrared radiation source is adapted to adjust its radiant output according to control commands received from the programmable infrared controller circuit.

7. The system of claim 6, wherein the programmable infrared controller circuit is adapted to tune the peak wavelength of the infrared output.

8. The system of claim 6, wherein the programmable infrared controller circuit is adapted, to pulse the infrared output according to a predetermined pattern.

9. The system of claim 6, wherein the programmable infrared controller circuit is adapted to raise the temperature of a an interface of a coating and a substrate, wherein the interface temperature is raised at a rate exceeding the rate at which the substrate temperature raises, and wherein the substrate temperature is taken to be the temperature averaged over the entire substrate.

10. The system of claim 9, wherein the programmable infrared controller circuit pulses the infrared radiation output so that the infrared radiation output rapidly heats the coating on the substrate without damaging the coating.

11. The system of claim 9, wherein the programmable infrared controller circuit tunes the infrared radiation output so that the infrared radiation penetrates to a predetermined depth into a coated substrate.

12. The system of claim 1 comprising at least two infrared radiation sources each defining a separate thermal heating zone.

13. The system of claim 1, wherein the at least one infrared radiation source is adapted to produce radiation at about 100 watts/in$^2$.

14. The system of claim 1, wherein the at least one infrared radiation source and the at least one UV radiation source are arranged in an in-line relation to each other.

15. The system of claim 1, wherein the at least one UV radiation source is adapted to adjust its radiant output according to control commands received from the programmable UV controller circuit.

16. The system of claim 1, wherein the at least one UV radiation source is adapted to produce radiation at about 600 watt/in$^2$.

17. The system of claim 1, wherein one or more of the radiation sources are adapted to emit an amount of radiation sufficient to cause a powder coating to gel and wet onto a substrate surface, wherein the coated substrate is disposed on the conveyor component.

18. The system of claim 2, wherein one or more of the radiation sources are adapted to emit an amount of radiation sufficient to cure a coating on a coated article carried by the conveyor component.

19. The system of claim 2, wherein one or more of the programmable infrared controller circuit, or the programmable UV controller circuit are adapted to record one or more of coating temperature, substrate temperature, infrared source voltage, UV source voltage, UV source temperature, or infrared source temperature.

20. The system of claim 1, wherein the conveyor controller circuit is adapted to position work pieces disposed on the conveyor in thermal and/or radiant zones for programmed amounts of time, and wherein the conveyor controller circuit is adapted to reverse the direction of the conveyor component.

* * * * *